United States Patent [19]

Chen et al.

[11] 4,412,892

[45] Nov. 1, 1983

[54] PRETREATMENT OF SUPERALLOYS AND STAINLESS STEELS FOR ELECTROPLATING

[75] Inventors: Edward S. Chen, Clifton Park; William Baldauf, Altamont, both of N.Y.

[73] Assignee: The United States of America as represented by the Secretary of the Army, Washington, D.C.

[21] Appl. No.: 282,909

[22] Filed: Jul. 13, 1981

[51] Int. Cl.[3] ..... C25D 5/34

[52] U.S. Cl. ..... 204/34; 204/32 R

[58] Field of Search ..... 204/29, 32 R, 34

[56] References Cited

U.S. PATENT DOCUMENTS 2,044,742 6/1936 Armstrong et al. ..... 204/1

3,287,237 11/1966 Wilton ..... 204/140

OTHER PUBLICATIONS

Metal Finishing Guide Book and Directory 1978, Metals and Plastics Publications, Inc., Hackensack, N.J., pp. 202–204.

*Primary Examiner*—G. L. Kaplan

*Assistant Examiner*—William Leader

*Attorney, Agent, or Firm*—Robert P. Gibson; Anthony T. Lane; A. Victor Erkkila

[57] ABSTRACT

Process for activating surfaces of superalloys and stainless steels prior to electroplating a metal such as chromium thereon, whereby a metal deposit having excellent adhesion to the substrate is obtained. The article is activated by anodic etching in a novel activation solution containing about 55% to 80% by volume of $H_2SO_4$ and about 1% to 10% by volume of commercial 52% hydrofluoric acid, preferably an aqueous bath containing 65% by volume of 95–98% $H_2SO_4$ and 5% by volume of 52% hydrofluoric acid at 30 A/dm$^2$ and 20° C. for one minute.

8 Claims, No Drawings

PRETREATMENT OF SUPERALLOYS AND STAINLESS STEELS FOR ELECTROPLATING

GOVERNMENT RIGHTS

The invention described herein may be manufactured, used and licensed by the Government for Government purposes without the payment to us of any royalty thereon.

BACKGROUND OF THE INVENTION

The present invention relates to a process for pretreating readily passivated metals, notably stainless steels and superalloys, for electroplating metals, such as chromium, nickel and cobalt, to produce deposits of greatly improved adhesion to the substrate.

The utility of superalloys in some defense oriented applications can be greatly improved by electroplating a coating of a metal, such as chromium, to change the surface properties of the alloy. However, superalloys, like stainless steels, are readily passivated by the formation of surface oxide films. Such films present special problems for electroplating, since they can reduce deposit adhesion, and special cleaning and processing is required to remove the films prior to plating, as is well known in the art.

Various methods are known for activating stainless steels for electroplating. These methods are generally discussed in ASTM Designation B254-53, "Preparation of and Plating Stainless Steels", September (1964), and include (a) cathodic or anodic treatments in alkaline or acidic solutions. (b) immersion treatments and (c) simultaneous activation using a strike intermediate layer. A strike layer of intermediate metal such as nickel, cobalt, zinc and cadmium is commonly employed to protect the stainless steel after activation; and since the strike layer itself is applied by electroplating, at least two electroplating steps are required in the process. Further, the effectiveness of the activation and strike layer decreases as the chromium content of the stainless steel increases.

Superalloys are alloys developed for very high temperature service where relatively high stresses are encountered and where oxidation resistance is frequently required (Metals Handbook 8th Edition Vol. 1, page 37). They are generally nickel, cobalt or iron-base alloys wherein the high temperature properties are derived through solid solution strengthening and hardening by precipitated metal carbide and gamma prime phases. Although superalloys are similar to stainless steels, it is not known whether the same activation methods are suitable for both. The few references on superalloys suggests the need for an intermediate strike layer in a viable activating process. However, the presence of the intermediate strike layer can exclude the electroplated alloy from service in high temperature environments.

It is an object of the present invention to provide a method for pretreating superalloys and stainless steels which overcomes the aforementioned problems and eliminates the need for an intermediate strike layer.

SUMMARY AND DETAILED DESCRIPTION OF THE INVENTION

In accordance with the process of the present invention the surface of a stainless steel or superalloy article prior to electroplating is activated by anodic etching in a novel activation solution containing about from 55% to 80% by volume of 95–98% sulfuric acid and about 1 to 10% by volume of 52% hydrofluoric acid. When the activated surface is electroplated in conventional manner with a metal such as chromium, the metal deposit obtained thereby without the use of an intermediate metal strike possesses greatly improved adhesion to the substrate. In similar manner, by utilizing the novel activation treatment of the present invention, other metals such as nickel, cobalt, copper and iron can be electroplated in conventional manner without the use of an intermediate metal strike to produce metal deposits characterized by excellent adhesion to the substrate.

The present invention is particularly suitable for activating nickel, cobalt and iron-base superalloys and stainless steels.

In carrying out the process of the present invention the stainless steel or superalloy article surface is submitted to anodic etching in the novel activation bath, i.e. by employing the article as the anode and using an inert cathode, such as lead or platinum. The article is preferably electroplated directly following the activation treatment, since it has been found that an intermediate rinse with water before electroplating the substrate with a metal, such as chromium, tends to decrease the adhesion of the metal deposit to the substrate. Also, it has been found that little, if any, improvement of adhesion of the electroplated metal to the substrate results when the article is submitted to cathodic etching in the novel activation solution under otherwise similar conditions.

The aqueous activation solutions employed in the process of the present invention contains about from 55% to 80% by volume of 95–98% $H_2SO_4$ (d. 1.84) and about 1% to 10% by volume of 52% by hydrofluoric acid of commerce, and preferably about 65% by volume of 95–98% $H_2SO_4$ and about 3 to 7% by volume of 52% hydrofluoric acid. Activation baths containing substantially more than 80 volume % of 95–98% $H_2SO_4$ promote excellent adhesion of electroplated metal deposits; but they are less preferred, since they are more costly and possess lower conductivity and higher viscosity. When the amount of 52% hydrofluoro acid in the activation solutions is increased substantially above 10% by volume of reduced substantially below 1% by volume, the electroplated metal deposits obtained possess considerably inferior adhesion to the substrate. Also, as shown in examples 10 and 11 below, aqueous solutions containing substantially lower concentrations of sulfuric acid, e.g. 30% by volume of 95–98% sulfuric acid, in mixture with 5% by volume of commercial 52% hydrofluoric acid, are essentially ineffective for activation and improving the adhesion of metal deposits electroplated on superalloy substrates.

The activation treatment can be carried out at a current density of at least about 20 A/dm$^2$, preferably between about 30 and 120 A/dm$^2$, and at a temperature preferably between room temperature and about 50° C. The duration of the activation treatment can vary widely. Excellent results can be obtained by treating the surface of the article in the activation solution for a period of 30 to 120 seconds.

The following examples illustrate specific embodiments of the method of carrying out the process of the present invention as well as other methods.

ACTIVATION PROCEDURE

Cylindrical samples, each one-inch long and three-quarters inch in diameter, were machined from GC-27, HS-25 and U-700 bar stock. (See Table 1 for compositions of these alloys) Each sample was secured in a parallel bar holder for grinding an end face of the cylindrical sample, the use of a parallel bar holder insuring that the sample can be removed and repositioned without changing surface alignment. After grinding the end face, the circumferential area of each sample was masked with heat shrinkable polypropylene tubing to expose only the flat end face for plating. No precleaning procedure was used prior to the surface activation treatment as the sample was used immediately following surface grinding.

The samples thus prepared were activated using the acid etching solutions and methods described in Table 2.

PLATING PROCEDURE

The plating solution employed was prepared by dissolving 250 grams/liter of $CrO_3$ (chromic acid) and 2.5 grams/liter of 95–98% sulfuric acid is distilled water. The samples obtained by the activation procedure described above were plated in the solution in a two liter beaker, using a platinum anode and rotation of the cathode (sample) with no other mechanical agitation. High contraction (HC) chromium was plated at a current density of 31 amperes per square decimeter ($A/dm^2$) and a solution temperature of $55° \pm 1°$ C., while low contraction (LC) chromium was plated at a current density of 150 $A/dm^2$ and at a temperature of $85° \pm 1°$ C.

ADHESION TESTS

The following procedure was employed to evaluate the HC and LC chromium deposits on the superalloy substrates obtained in the foregoing examples.

The sample with chromium deposited to a thickness of 75$\mu$ was returned to the parallel bar holder and secured, after which parallel grooves were cut across the plated surface to a depth just below the interface using a small metal shaper equipped with a carbide tool. The degree of adhesion was evaluated with the aid of a low power optical microscope. The optimum conditions for the adhesion test were determined by studying chromium deposits of various thicknesses (25 to 150 m), grooves of various depths (0.125 to 1 mm from the interface), distance of groove separation (0.75 to 2.5 mm) and different speeds of the cutting tool. The optimum results were obtained by employing a 75$\mu$ thick chromium deposit with the parallel grooves cut to a depth of 175$\mu$ from the interface at a separation of 1 mm and using a tool speed of about 7.5 cm/sec.

The foregoing test is sufficiently sensitive to distinguish the following four classes of adhesion:

- Excellent: fracture occurs only within the chromium layer or the coating on the land remains undamaged.
- Good: fracture occurs predominantly in the chromium layer.
- Poor: fracture occurs predominantly at the interface.
- No adhesion: coating detaches completely at the interface or spalls during plating.

Table 2 sets forth an evaluation of the adhesion of chromium coatings electroplated on the superalloys after various activation treatments. The results show that the activation process of the present invention is the only method which produced a significant improvement in the adhesion of the chromium deposit.

Example 1 shows the adhesion obtained on a freshly ground superalloy surface without an activation pretreatment.

Example 2 shows a process described in page 203, Electroplating Engineering Handbook, Third Edition, A. K. Graham Ed., Van Nostrand Reinhold Co. (1971). This is the only process found in a literature search which does not employ strike plating in the activation step. This treatment consists in the following order: a one minute immersion in a 20% hydrochloric acid solution, a water rinse, a one-half minute immersion in a 67% nitric acid solution, a water rinse, a ½ minute immersion in the chromic acid plating solution followed by plating in the same solution.

Example 3 shows cathodic pretreatment in a conventional chromic acid plating solution, i.e., the alloy sample is the cathode.

Example 4 shows anodic pretreatment in the chromic acid plating solution, wherein the alloy sample is the anode.

Example 5–9 show anodic and cathodic pretreatments in 30%, 65% and concentrated sulfuric acid solutions.

Examples 10 and 11 show anodic and cathodic pretreatments in an aqueous solution containing 30% by volume of 95–98% $H_2SO_4$ and 5% by volume of commercial 52% hydrofluoric acid. This solution is recommended for use on stainless steels (Metal Finishing Handbook, 77 (13), January 1979) and is said to be excellent for the simultaneous activation of landing gear steel and nickel plated surfaces (G. T. Sink, Plating and Surface Finishing, 63 (8), 20 (1976)). The adhesion of the chromium plate obtained on all three superalloys using both anodic and cathodic pretreatments in this $H_2SO_4$-HF solution with one exception was "poor" or "no adhesion."

Example 12 illustrates the activation process of the present invention. It shows anodic pretreatment in an aqueous solution containing 65% by volume of concentrated sulfuric acid and 5% by volume of commercial hydrofluoric acid (650 ml. 95–98% $H_2SO_4$ d. 1.84 and 50 ml commercial 52% hydrofluoric acid diluted to one liter with distilled water). Excellent adhesion of metal deposits were thereby obtained on all three superalloys.

Table 3 shows the effects of hydrofluoric acid concentration and etching time on the adhesion of chromium deposits on U-700 alloy. In these examples the amount of 52% hydrofluoric acid was varied from 1.25 to 7 percent by volume and the etching time was varied from 15 to 120 seconds while the amount of concentrated (95–98%) $H_2SO_4$ was maintained at 65% by volume. Etching was conducted anodically at a current density of 31 $A/dm^2$. Except for the inconsistent results obtained with the 15 second etch, excellent adhesion of the chromium deposit was obtained when longer etching times were employed.

The process of the present invention can also be utilized for stainless steels. For example the activation solution and procedure described in Example 12 was employed for plating chromium by the aforementioned procedure on 304, 316 and 410 stainless steels (see Table 1 for the compositions of these stainless steels). The adhesion of the chromium deposits thus produced on each of these substrates was found to be excellent, as measured by the aforementioned adhesion test.

The foregoing disclosure is merely illustrative of the principles of this invention and is not to be interpreted in a limiting sense. We wish it to be understood that we do not desire to be limited to the exact details described because obvious modifications will occur to a person skilled in the art.

TABLE 1

PRIMARY COMPOSITION OF SELECTED SUPERALLOYS AND STAINLESS STEELS

| | Ni | Co | Fe | Cr | Mo | Mn | Ti | Al | W | C | Si | P | S |
|---|---|---|---|---|---|---|---|---|---|---|---|---|---|
| U-700 | Bal. | 18.5 | 0.5 | 15 | 5.0 | — | 3.5 | 4.4 | — | 0.07 | — | — | — |
| HS-25 | 10 | Bal. | 3.0 | 20 | — | 1.5 | — | — | 15 | 0.10 | 0.5 | — | — |
| CG-27 | 38 | — | Bal. | 13 | 5.5 | 0.1 | 2.5 | 1.5 | — | 0.05 | 0.1 | — | — |
| 304 | 8–10.5 | — | Bal. | 18–20 | — | 2.0 | — | — | — | 0.08 | 1.0 | 0.045 | 0.030 |
| 316 | 10–14 | — | Bal. | 16–18 | 2–3 | 2.0 | — | — | — | 0.08 | 1.0 | 0.045 | 0.030 |
| 410 | — | — | Bal. | 12 | — | — | — | — | — | 0.02 | 0.8 | 0.006 | 0.025 |

TABLE 2

ADHESION OF HC CHROMIUM ON SUPERALLOYS

| Example | Activation (Etching) Solution | Pretreatment Condition | Adhesion CG-27 | Adhesion U-700 | Adhesion HS-25 |
|---|---|---|---|---|---|
| 1 | None | Freshly Ground Surface | Poor | Poor | Poor |
| 2 | 20% HCl, 67% $HNO_3$, 250/2.5 g/l; $CrO_3/H_2SO_4$ | Immersion, water rinse 1 min., ½ min., ½ min. | Excellent | Poor | Poor |
| 3 | 250/2.5 g/l; $CrO_3/H_2SO_4$ | Cathodic, 2.4 v, 15 min. | Good | No adhesion | No adhesion |
| 4 | 250/2.5 g/P; $CrO_3/H_2SO_4$ | Anodic, 31 A/dm$^2$, 2 min. | Good | No adhesion | No adhesion |
| 5 | 30% $H_2SO_4$ | Anodic, 31 A/dm$^2$, 1 min. | No adhesion | Poor | No adhesion |
| 6 | 65% $H_2SO_4$ | Anodic, 31 A/dm$^2$, 1 min. | Poor | Poor | Poor |
| 7 | 65% $H_2SO_4$ | Anodic, 31 A/dm$^2$, 2 min. | Good | Poor | Poor |
| 8 | Conc. $H_2SO_4$(Sp. gr. 1.84) | Anodic, 31 A/dm$^2$, 1 min. | No adhesion | Poor | Poor |
| 9 | Conc. $H_2SO_4$(Sp. gr. 1.84) | Cathodic, 31 A/dm$^2$, 1 min. | No adhesion | Poor | No adhesion |
| 10 | 30% $H_2SO_4$ + 5% HF | Anodic, 31 A/dm$^2$, 2 min. | Excellent | Poor | Poor |
| 11 | 30% $H_2SO_4$ + 5% HF | Cathodic, 31 A/dm$^2$, 2 min. | No adhesion | No adhesion | No adhesion |
| 12 | 65% $H_2SO_4$ + 5% HF | Anodic, 31 A/dm$^2$, 1 min. | Excellent | Excellent | Excellent |

TABLE 3

ADHESION OF HC CHROMIUM ON U-700 AS A FUNCTION OF ETCHING TIME AND HYDROFLUORIC ACID CONCENTRATION*

| HR (%) | Time (sec) 15 | 30 | 60 | 120 |
|---|---|---|---|---|
| 7 | Good | Ex | Ex | — |
| 5 | Poor | Ex | Ex | Ex |
| 2.5 | Ex | Ex | Ex | Ex |
| 1.25 | Poor | Ex | Ex | — |

*All solutions contain 65% sulfuric acid. Etching was conducted anodically at a current density of 31 A/dm$^2$.

We claim:

1. A process for electroplating a metal on a substrate of superalloy, which comprises activating the substrate surface by anodic etching in an aqueous solution consisting essentially of about from 55% to 80% by volume of 95–98% sulfuric acid and about from 1 to 10% by volume of 52% hydrofluoric acid at a current density of at least 20 A/dm$^2$, and electroplating the activated surface with a metal of the group consisting of chromium, nickel, cobalt, copper and iron.

2. A process according to claim 1 wherein the metal for electroplating is chromium.

3. A process according to claim 4, wherein the chromium is electroplated from an aqueous solution of chromic acid and sulfuric acid.

4. A process according to claim 1, wherein the activating solution consists essentially of an aqueous mixture of about 65% by volume sulfuric acid and about 3% to 7% by volume hydrofluoric acid.

5. A process according to claim 1, wherein the anodic etching is carried out at a current density of about 30 to 120 A/dm$^2$.

6. A process according to claim 1, wherein the duration of the anodic activation treatment ranges about from 30 to 120 seconds.

7. The process according to claim 1, wherein the activated substrate surface is directly electroplated with the metal without an intermediate rinse with water.

8. The process according to claim 1, wherein the superalloy is selected from the group consisting of CG-27, U-700 and HS-25.

* * * * *